US007831157B2

(12) United States Patent
Yamaguchi et al.

(10) Patent No.: US 7,831,157 B2
(45) Date of Patent: Nov. 9, 2010

(54) TOTAL LAYER THICKNESS DETECTION APPARATUS, CHARGING DEVICE, IMAGE FORMING APPARATUS, TOTAL LAYER THICKNESS DETECTION METHOD AND COMPUTER READABLE MEDIUM STORING PROGRAM FOR TOTAL LAYER THICKNESS DETECTION

(75) Inventors: Hidehiko Yamaguchi, Ebina (JP); Chikaho Ikeda, Ebina (JP); Hideki Moriya, Ebina (JP); Masao Ohmori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 362 days.

(21) Appl. No.: 11/987,367

(22) Filed: Nov. 29, 2007

(65) Prior Publication Data

US 2008/0317488 A1 Dec. 25, 2008

(30) Foreign Application Priority Data

Jun. 22, 2007 (JP) ..... 2007-165037

(51) Int. Cl.
*G03G 15/00* (2006.01)

(52) U.S. Cl. ..... 399/26

(58) Field of Classification Search ..... 399/26, 399/50

See application file for complete search history.

(56) References Cited

U.S. PATENT DOCUMENTS 5,485,248 A * 1/1996 Yano et al. ..... 399/73

FOREIGN PATENT DOCUMENTS

| | | |
|---|---|---|
| JP | A 05-223513 | 8/1993 |
| JP | B2 3064643 | 5/2000 |

* cited by examiner

*Primary Examiner*—David M Gray
*Assistant Examiner*—Gregory H Curran
(74) *Attorney, Agent, or Firm*—Oliff & Berridge PLC

(57) ABSTRACT

A total layer thickness detection apparatus for a charged body includes: a saturated charge amount detection unit that detects a saturated charge amount of a charged body having plural coating layers with mutually different relative dielectric constants; a storage unit that stores relation information indicating relation of change of the saturated charge amount of the charged body with respect to a change of layer thickness of a surface layer of the charged body; and a calculation part that calculates a total layer thickness of the plural coating layers of the charged body based on the change of the saturated charge amount detected by the saturated charge amount detection unit and the relation information stored in the storage unit.

20 Claims, 10 Drawing Sheets

IMAGE FORMING APPARATUS10

FIG.5

| | LAYER THICKNESS (FILM THICKNESS) | RELATIVE DIELECTRIC CONSTANT | ABRASION RATE |
|---|---|---|---|
| OVERCOAT LAYER | 5 μm | 4. 5 | 3nm/Kcycle |
| CHARGE TRANSPORT LAYER | 20 μm | 3 | 30nm/Kcycle |
| CHARGE GENERATION LAYER | 0. 15 μm | — | — |

FIG.9A

| VARIATION SAMPLE | CHANGE AMOUNT OF SATURATED CHARGE AMOUNT Q WITH RESPECT TO 1 μm ABRASION OF OC LAYER (INCLINATION α : RELATION INFORMATION) |
|---|---|
| VARIATION a | A |
| VARIATION b | B |
| VARIATION c | C |
| ⋮ | ⋮ |
| VARIATION i | I |

FIG.9B

| INITIAL VALUE OF SATURATED CHARGE AMOUNT Q | VARIATION SAMPLE |
|---|---|
| Qa0 | VARIATION a |
| Qb0 | VARIATION b |
| Qc0 | VARIATION c |
| ⋮ | ⋮ |
| Qi0 | VARIATION i |

S10

TOTAL LAYER THICKNESS DETECTION APPARATUS, CHARGING DEVICE, IMAGE FORMING APPARATUS, TOTAL LAYER THICKNESS DETECTION METHOD AND COMPUTER READABLE MEDIUM STORING PROGRAM FOR TOTAL LAYER THICKNESS DETECTION

CROSS-REFERENCE TO RELATED APPLICATIONS

This application is based on and claims priority under 35 USC 119 from Japanese Patent Application No. 2007-165037 filed Jun. 22, 2007.

BACKGROUND

1. Technical Field

The present invention relates to a total layer thickness detection apparatus, a charging device, an image forming apparatus, a total layer thickness detection method and a computer readable medium storing a program for total layer thickness detection.

2. Related Art

SUMMARY

According to an aspect of the invention, there is provided a total layer thickness detection apparatus for a charged body including: a saturated charge amount detection unit that detects a saturated charge amount of a charged body having plural coating layers with mutually different relative dielectric constants; a storage unit that stores relation information indicating relation of change of the saturated charge amount of the charged body with respect to a change of layer thickness of a surface layer of the charged body; and a calculation part that calculates a total layer thickness of the plural coating layers of the charged body based on the change of the saturated charge amount detected by the saturated charge amount detection unit and the relation information stored in the storage unit.

BRIEF DESCRIPTION OF THE DRAWINGS

An exemplary embodiment of the present invention will be described in detail based on the following figures, wherein:

FIG. 5 is a table showing the result of comparison among members constituting the image carrier;

FIG. 9A is a table showing relation information in a relation information database included in the management program;

FIG. 9B is a table showing correspondence between previously-calculated different plural initial values of the saturated charge amount Q and plural variation samples in an image carrier in a correspondence information database included in the management program.

DETAILED DESCRIPTION

Next, an exemplary embodiment of the present invention will be described based on the drawings.

Figure 1:
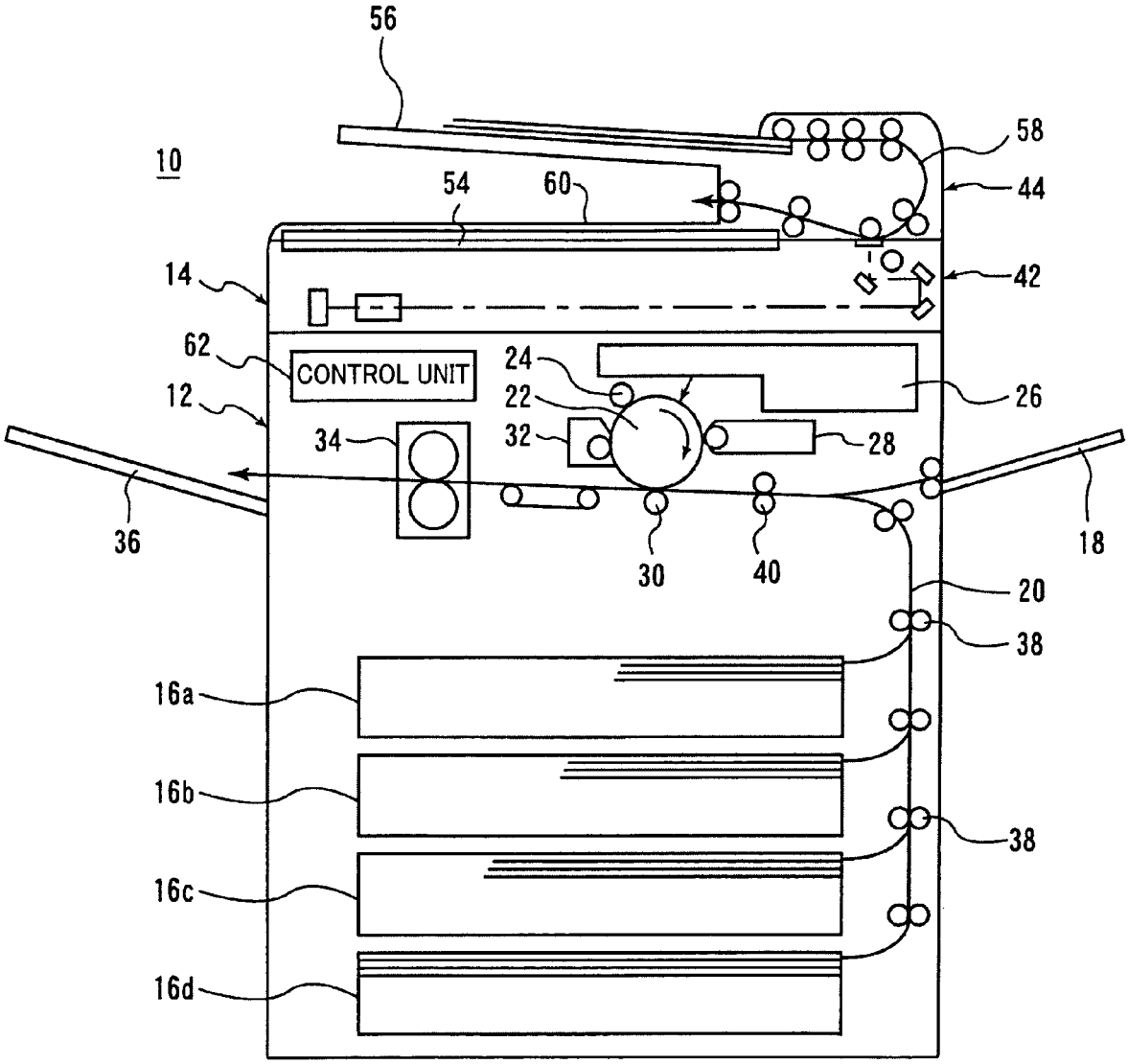
FIG. 1 is a cross-sectional view showing a structure of an image forming apparatus according to an exemplary embodiment of the present invention.
Figure 2:
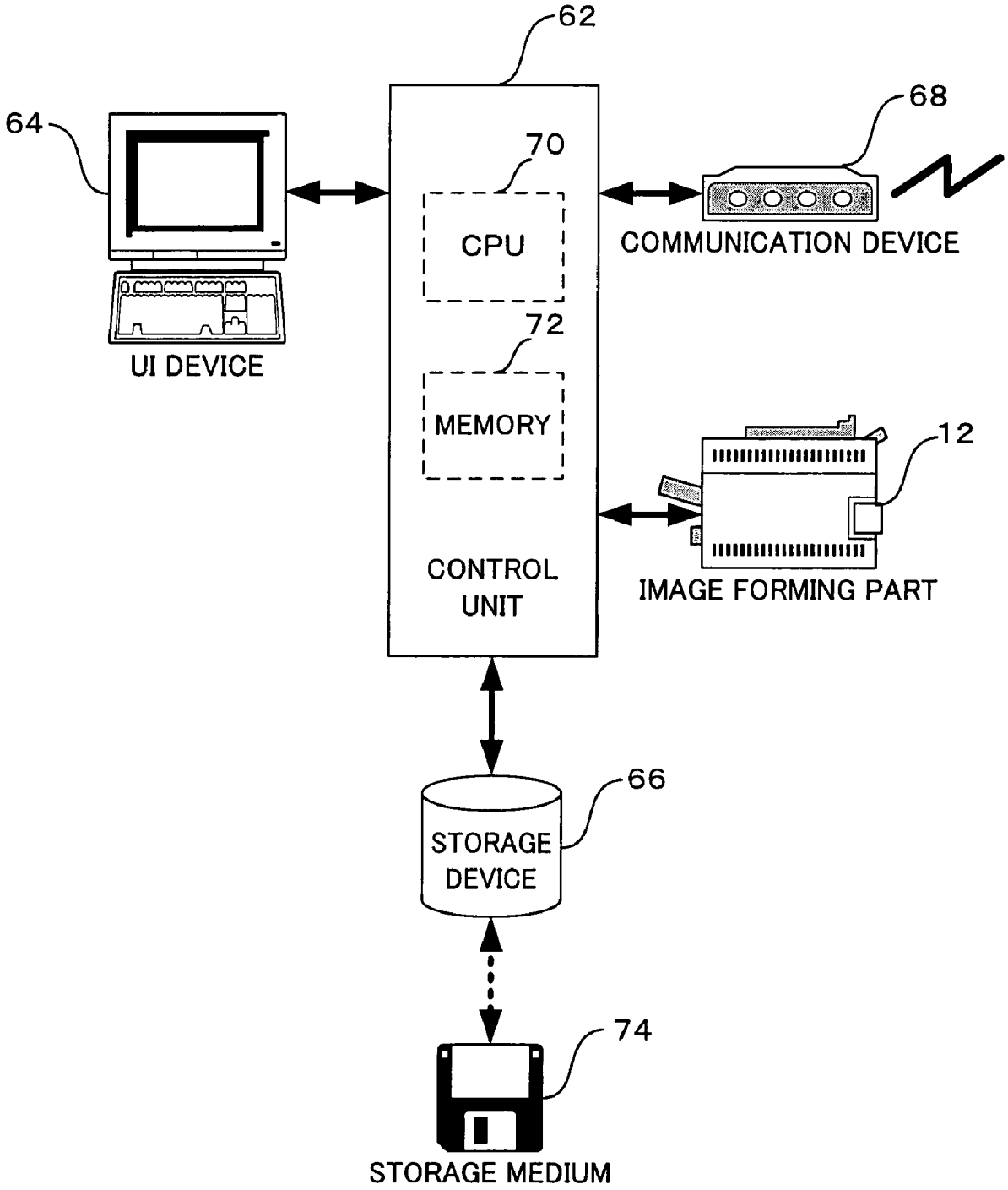
FIG. 2 shows a configuration of the image forming apparatus according to the exemplary embodiment of the present invention.

FIGS. 1 and 2 schematically show the outline of an image forming apparatus 10 according to the exemplary embodiment of the present invention. The image forming apparatus 10 has an image forming part 12 and a document reading device 14. The image forming part 12, which is e.g. a xerography type unit, has a four stages of paper feed trays 16*a* to 16*d* on which recording media such as paper sheets are stacked and a manual feed tray 18. The image forming part 12 forms an image on a recording medium supplied from these trays 16*a* to 16*d* and 18 to a recording medium transport path 20.

That is, the image forming part 12 has a rotating image carrier 22 having e.g. a cylindrical shape, a charging member 24 of e.g. a charging roller to uniformly charge the image carrier 22, an exposure device (optical writing device) 26 to form an electrostatic latent image on the image carrier 22 uniformly charged by the charging member 24, a developing device 28 to visualize the latent image on the image carrier 22 formed by the exposure device 26 with developer, a transfer device 30 to transfer the toner image formed by the developing device 28 onto a recording medium, and a cleaner 32 to clean the toner remaining on the image carrier 22.

The charging member 24, having an elastic member such as rubber on its surface, rotates in contact with the image carrier 22. The exposure device 26, which is a laser-scan type device, converts an image of an original read by the document reading device 14 to a laser on/off signal and outputs the signal. The transfer device 30, having e.g. a transfer roller, transfers a toner image onto a recording medium and sends the recording medium to a fixing device 34. The toner image is fixed to the recording medium by the fixing device 34. The recording medium on which the toner image is fixed is discharged to the discharge tray 36.

The recording medium transport path 20 is provided with plural recording medium feed rollers 38. A registration roller 40 is provided around the upstream side of the transfer device 30 as one of the recording medium feed rollers. The registration roller 40 temporarily stops a supplied recording medium, and in synchronization with the timing of formation of latent image on the image carrier 22, supplies the recording medium to the transfer device 30.

The document reading device 14 has an optical system 42 to optically read an original and an automatic document feeding device 44.

The optical system 42 has a function of skimming through an original fed by the automatic document feeding device 44 and a function of reading an original placed on a document table glass 54 by scanning a reflecting mirror or the like.

The automatic document feeding device 44 has an original table 56 on which a number of originals are placed, a document conveyance path 58, and a discharge plate 60 on which an original after reading is discharged.

Further, the image forming apparatus 10 has a control unit 62, a user interface device (UI device) 64 including a display, a keyboard and the like, a storage device 66 such as an HDD or a CD, a communication device 68, and the like. The control unit 62, including a CPU 70 and a memory 72, controls the respective elements constituting the image forming apparatus 10.

In this manner, the image forming apparatus 10, including a function as a computer, executes a program received via a storage medium 74 or the communication device 68 thereby performs printing or the like.

Next, the image carrier 22, the charging member 24 and its peripheral portion will be described in detail.

Figure 3:
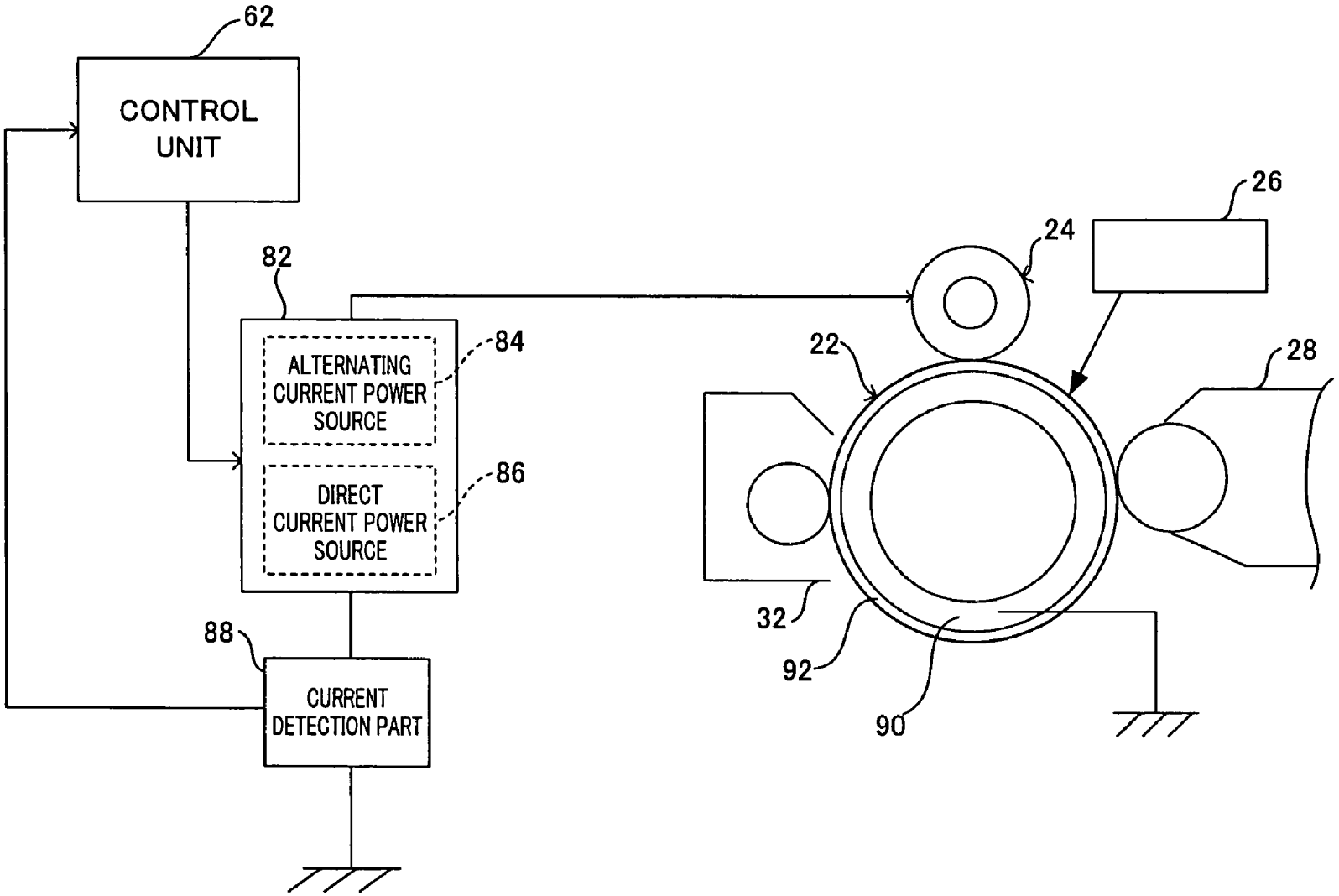
FIG. 3 schematically shows an image carrier, a charging member and the details of its peripheral portion.

FIG. 3 schematically shows the image carrier 22, the charging member 24 and the details of its peripheral portion. The charging member 24 is connected with a power source part (power supply unit) 82. The power source part 82, having an alternating current power source 84 and a direct current power source 86, applies a voltage obtained by superposing an alternating current voltage Vac on a predetermined direct current voltage Vdc to the charging member 24 in correspondence with the control by the control unit 62. For example, in the power source part 82, the alternating current power source 84 applies an alternating current voltage, at a frequency of 1000 Hz and with a peak-to-peak voltage Vpp of about 800 to 2500 V, to the charging member 24, and the direct current power source 86 applies a direct current voltage Vdc of about −750 V to the charging member 24, thus a predetermined electric current is supplied to the charging member 24. A current detection part 88 detects the electric current supplied from the power source part 82 to the charging member 24, and outputs the result of detection to the control unit 62.

Figure 4:
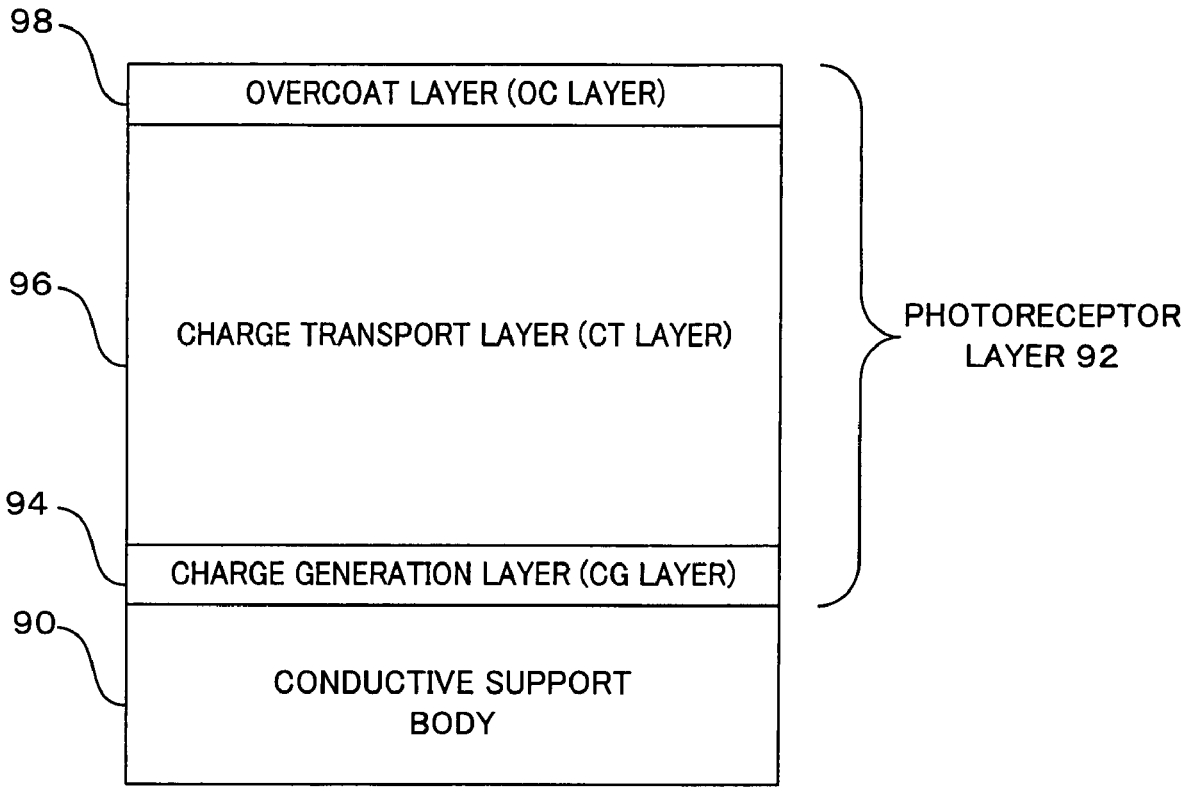
FIG. 4 schematically shows the structure of a cross section of the image carrier.

The image carrier 22 has a grounded conductive support body 90 of e.g. aluminum having a cylindrical shape, and a photoreceptor layer 92 covering the outer surface of the conductive support body 90. As shown in FIG. 4, the photoreceptor layer 92 has e.g. a charge generation layer 94, a charge transport layer (CT layer) 96 and an overcoat layer (OC layer) 98. As shown in FIG. 5, the charge generation layer 94, having a layer thickness (film thickness) of 0.15 μm and including charge carrier generation material, covers the conductive support body 90. The charge transport layer 96, having a member including charge carrier transport material, having a relative dielectric constant of e.g. 3, and having a layer thickness of about 20 μm, is deposited outside the charge generation layer 94. The overcoat layer 98, having a member with a relative dielectric constant of e.g. 4.5, and having a layer thickness of about 5 μm, is deposited outside the charge transport layer 96. Further, the hardness of the overcoat layer 98 is higher than that of the charge transport layer 96. For example, the charge transport layer 96 is worn away by about 30 nm per 1000 cycle processing, whereas the overcoat layer 98 is worn away by about 3 nm per 1000 cycle processing.

Figure 6:
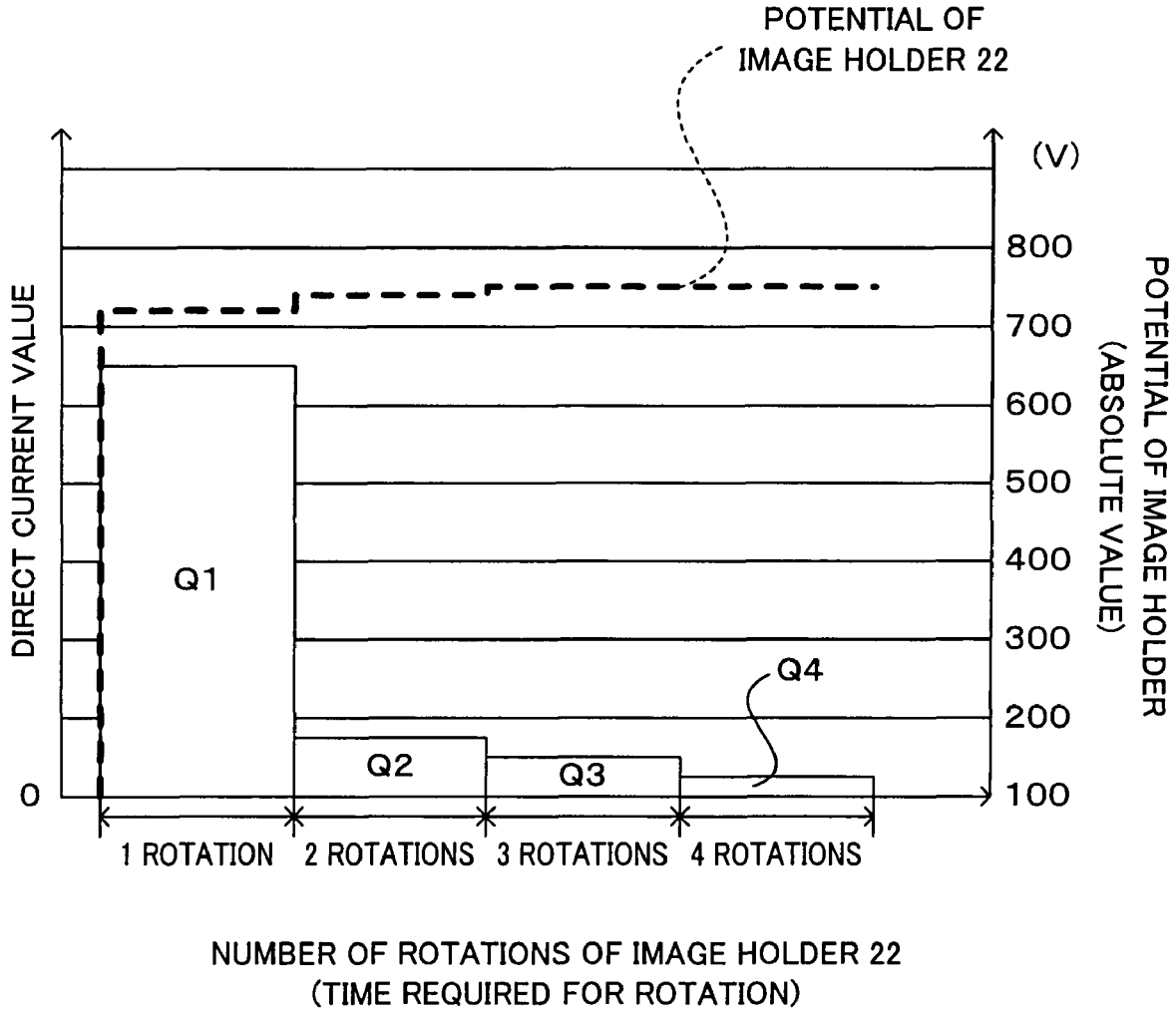
FIG. 6 is a graph showing the relation between a direct current value detected by a current detection part and a potential of the image carrier.

FIG. 6 is a graph showing the relation between a direct current value detected by the current detection part 88 and a potential of the image carrier 22. The power source part 82 applies an alternating current voltage and a direct current voltage to the charging member 24 so as to charge the image carrier 22. The direct current voltage applied by the direct current power source 86 to the charging member 24 is −750 V. When the −750 V direct current voltage is applied to the charging member 24 and the image carrier 22 rotates once, the image carrier 22 is charged to about −720 V. The control unit 62 calculates a charge amount Q1 in correspondence with the direct current value including the charging current and a leak current detected by the current detection part 88. In the image carrier 22, the charge amount is not saturated after the rotation.

When the image carrier 22 rotates twice, the image carrier 22 is charged to about −740 V. The control unit 62 calculates a charge amount Q2 in correspondence with the direct current value including the charging current and a leak current detected by the current detection part 88. In the image carrier 22, the charge amount is not saturated after the second rotation. When the image carrier 22 rotates three times, the image carrier 22 is charged to about −750 V, and the control unit 62 calculates a charge amount Q3 in correspondence with the direct current value including the charging current and a leak current detected by the current detection part 88. In the image carrier 22, the charge amount is saturated after the third rotation. When the image carrier 22 rotates four times, as the charge amount in the image carrier 22 has been saturated, the control unit 62 calculates a charge amount Q4 in correspondence with the direct current value including only the leak current detected by the current detection part 88. Note that the leak current detected by the current detection part 88 includes a leak current which is changed in correspondence with a voltage value applied from the power source part 82 and a leak current which flows independent of the voltage value applied from the power source part 82.

The charge amounts Q1 to Q3 calculated by the control unit 62 by the third rotation of the image carrier 22 respectively include the charge amount Q4 corresponding to the leak current. The control unit 62 detects a saturated charge amount Q of the image carrier 22 by calculation using the following expression.

$$\text{Saturated charge amount } Q = Q1 + Q2 + Q3 - Q4 \times 3 \quad (1)$$

Further, as described above, as the image carrier 22 is a cylindrical member, it is worn away from the outer surface side by contact with the charging member 24. When the total layer thickness of the photoreceptor layer 92 is decreased by abrasion, the saturated charge amount Q is increased.

Figure 7:
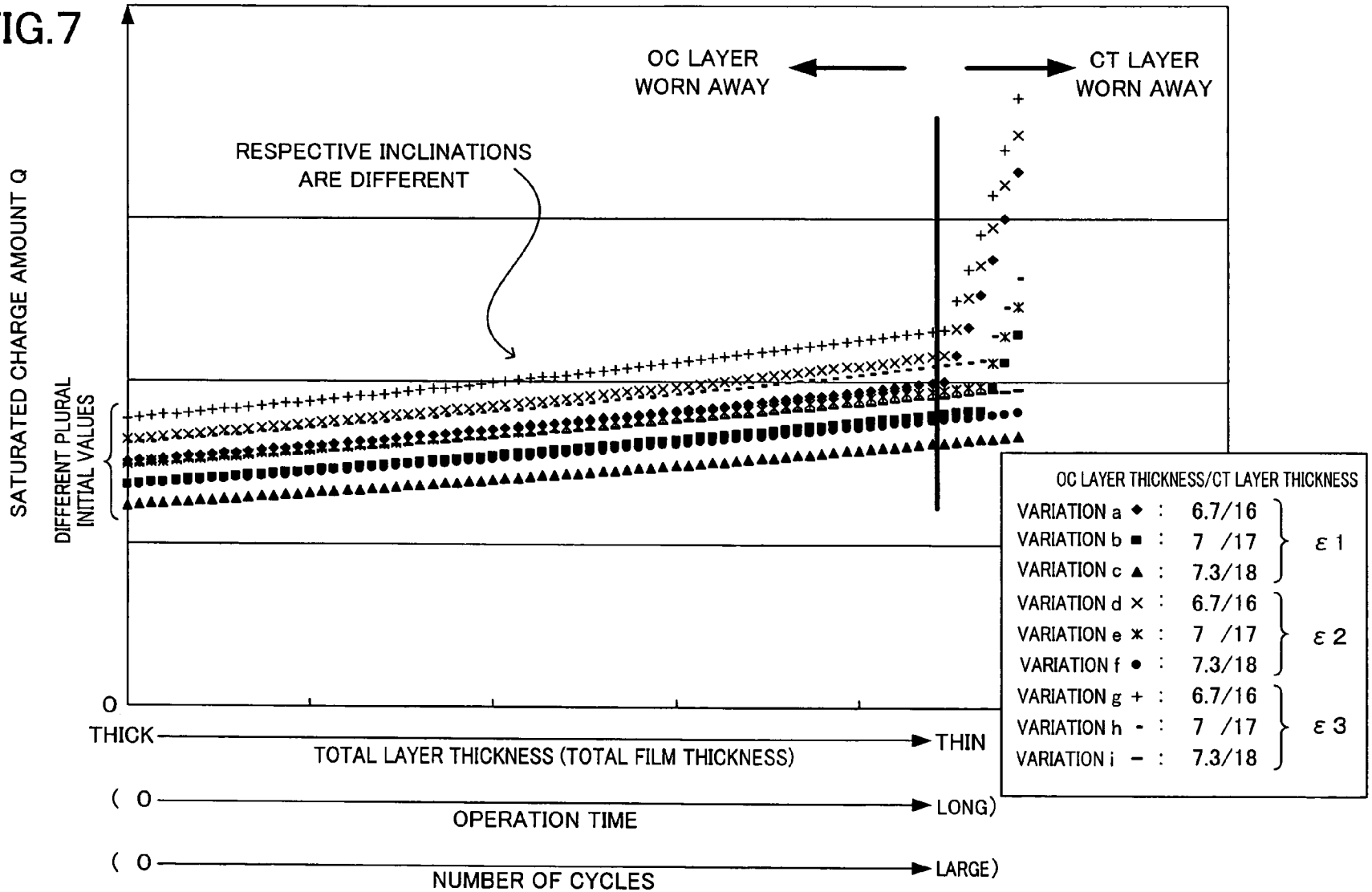
FIG. 7 is a graph showing the result of calculation of changes of saturated charge amount Q of the image carrier with respect to decrement of a total layer thickness of a photoreceptor layer in correspondence with variations of the photoreceptor layer within tolerance.

FIG. 7 is a graph showing the result of calculation of change of the saturated charge amount Q of the image carrier 22 with respect to decrement of the total layer thickness of the photoreceptor layer 92 in correspondence with variations of the photoreceptor layer 92 within tolerance. Note that FIG. 7 shows nine variation samples (variations a to i), i.e., variations of the layer thickness of the overcoat layer 98, 4.5 μm, 5 μm and 5.5 μm; variations of the layer thickness of the charge transform layer 96, 19 μm, 20 μm and 21 μm; and variations of the relative dielectric constant, $\epsilon 1$, $\epsilon 2$ and $\epsilon 3$.

As shown in FIG. 7, the saturated charge amount Q of the image carrier 22 is increased in inverse proportion to the decrement of the total layer thickness of the photoreceptor layer 92 until the total layer thickness of the photoreceptor layer 92 becomes a predetermined value. As described above, as the overcoat layer (OC layer) 98 is the surface layer of the cylindrical image carrier 22, the photoreceptor layer 92 begins to be worn away from the overcoat layer 98 in correspondence with the number of image formations (the number of cycles or operation time) of the image forming apparatus 10. Further, only the overcoat layer 98 is worn away until the total layer thickness of the photoreceptor layer 92 becomes a predetermined thickness, and when the photoreceptor layer 92 is further worn away, the charge transport layer (CT layer) 96 begins to be worn away, then the saturated charge amount Q in the image carrier 22 begins to be rapidly increased.

In the image carrier 22, as the charge transport layer 96 and the overcoat layer 98 vary as in the case of the variations a to i by image forming apparatus 10, the initial value of the saturated charge amount Q and the amount of change in the saturated charge amount (inclination a) of the image carrier 22 with respect to the amount of abrasion (layer thickness decrement amount) of the overcoat layer 98 vary in correspondence with the variations of the charge transport layer 96 and the overcoat layer 98. Note that the different values of the inclination a respectively correspond to the different initial values of the saturated charge amount Q.

Next, processing performed by the control unit 62 for management of the image carrier 22 will be described.

Figure 8:
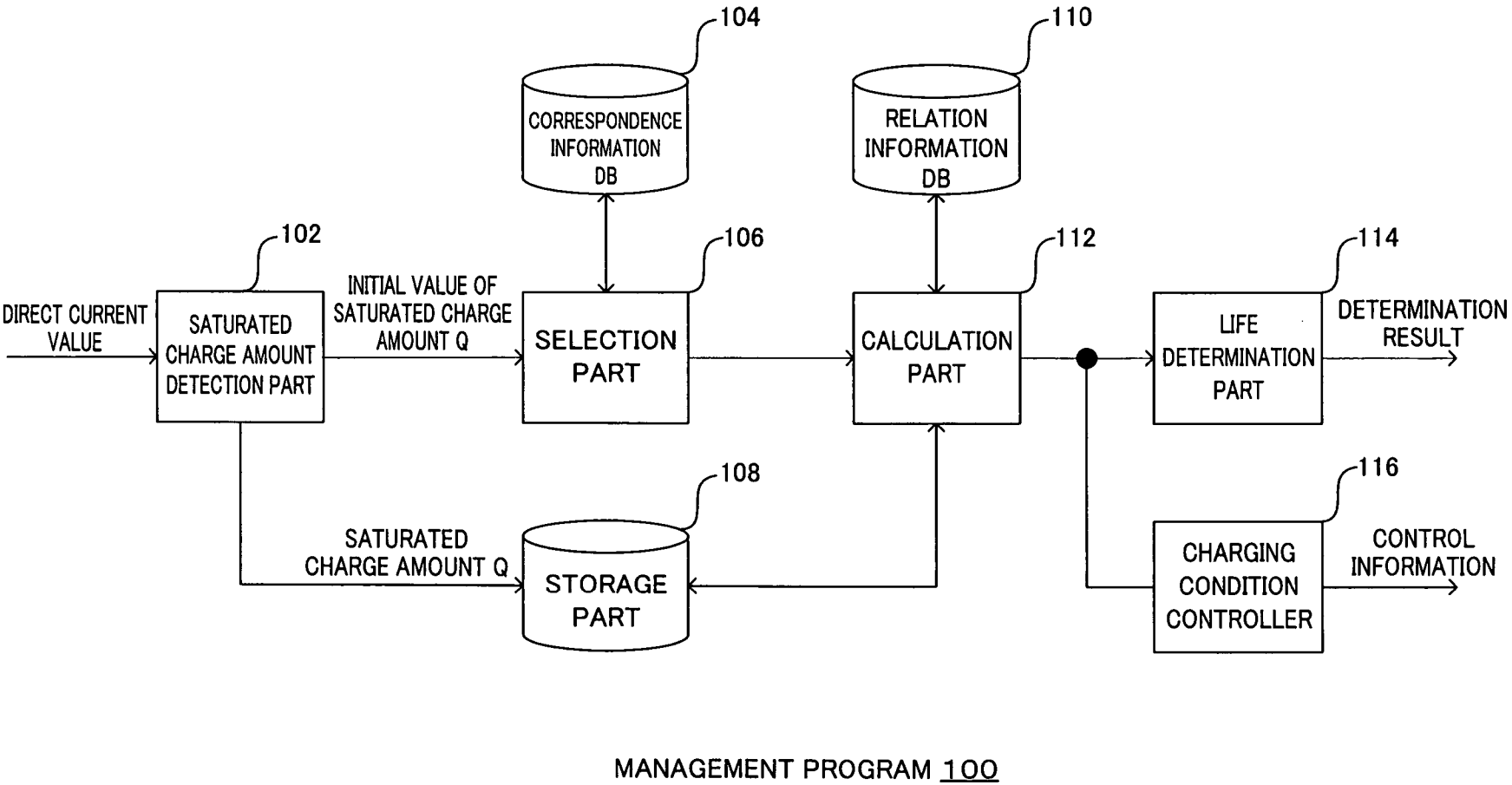
FIG. 8 is a block diagram showing the configuration of a management program executed by a control unit for management of the image carrier.

FIG. 8 is a block diagram showing the configuration of a management program 100 executed by the control unit 62 for management of the image carrier 22.

As shown in FIG. 8, the management program 100 has a saturated charge amount detection part 102, a correspondence information database 104, a selection part 106, a storage part 108, a relation information database 110, a calculation part 112, a life determination part 114 and a charging condition controller 116.

The saturated charge amount detection part 102 receives a current value detected by the current detection part 88, detects the saturated charge amount Q by use of the above expression (1), and outputs the saturated charge amount Q to the storage part 108 to be described later. Further, when the detected saturated charge amount Q is an initial value, the saturated charge amount detection part 102 also outputs the result of detection to the selection part 106.

As shown in FIG. 9B, the correspondence information database 104 shows correspondence between previously-calculated different plural initial values of the saturated charge amount Q and the plural variation samples in the image carrier 22. For example, the correspondence information database 104 is stored in the memory 72, and in accordance with access from the selection part 106, data is outputted to the selection part 106. Note that the correspondence information database 104 stores plural correspondence information pieces in which the plural inclination a values are applied to the respective plural initial values of the saturated charge amount Q (relation information to be described later using FIG. 9A) via the variation sample names (the variations a to i).

The selection part 106 receives an initial value of the saturated charge amount Q detected by the saturated charge amount detection part 102 and accesses the correspondence information database 104. Then the selection part 106 selects a variation sample corresponding to an initial value closest to the received initial value, and outputs the result of selection to the calculation part 112.

The storage part 108 stores the respective saturated charge amounts Q detected by the saturated charge amount detection part 102, and outputs a value of the stored saturated charge amount Q in accordance with access from the calculation part 112.

As shown in FIG. 9A, the relation information database 110 stores data showing the change amount of the saturated charge amount Q (inclination α value: relation information) of the image carrier 22 with respect to the abrasion of the overcoat layer (OC layer) 98 by 1 μm (decrement of layer thickness by 1 μm), by variation sample. For example, the relation information database. 110 is stored in the memory 72, and in accordance with access from the calculation part 112, data is outputted to the calculation part 112.

The calculation part 112 receives the result of selection of variation sample from the selection part 106, receives an inclination a value (relation information) corresponding to the selected variation sample from the relation information database 110. Then the calculation part 112 accesses the storage part 108, calculates the amount of abrasion of the photoreceptor layer 92 (layer thickness decrement amount) by use of the following expression (2), calculates the total layer thickness of the photoreceptor layer 92 by use of the following expression (3), and outputs the respective calculation results corresponding to the selected variation sample to the life determination part 114 and the charging condition controller 116.

$$\text{Amount of abrasion of photoreceptor layer 92 (layer thickness decrement amount)} = \alpha(Qm - Q\times 0) \quad (2)$$

α: inclination (relation information: any one of A to I)

Qm: detection value of saturated charge amount

Q×0: initial value of saturated charge amount (any one of Qa0 to Q10)

$$\text{Total layer thickness } D \text{ of photoreceptor layer 92} = Dx - \alpha(Qm - Q\times 0) \quad (3)$$

Dx: initial value of total layer thickness of photoreceptor layer 92 (any one of D1 to D3)

α: inclination (relation information: any one of A to I)

Qm: detection value of saturated charge amount

Q×0: initial value of saturated charge amount (any one of Qa0 to Q10)

Note that in the above expression (3), as shown in FIG. 7, as the initial value Dx of the total layer thickness of the photoreceptor layer 92, any one of D1 to D3 shown in the following expressions is set for the respective variation samples (variations a to i).

$$\begin{aligned} D1 &= OC \text{ layer} + CT \text{ layer} + \text{charge generation layer} \\ &= 4.5 + 19 + 0.15 \\ &= 23.65\ (\mu m) \end{aligned} \quad (4)$$

$$\begin{aligned} D2 &= OC \text{ layer} + CT \text{ layer} + \text{charge generation layer} \\ &= 5 + 20 + 0.15 \\ &= 25.15\ (\mu m) \end{aligned} \quad (5)$$

$$\begin{aligned} D3 &= OC \text{ layer} + CT \text{ layer} + \text{charge generation layer} \\ &= 5.5 + 21 + 0.15 \\ &= 26.65\ (\mu m) \end{aligned} \quad (6)$$

Then, the calculation part 112 selects the initial value Dx of the total layer thickness from D1 to D3 in correspondence with the variation sample selected by the selection part 106.

The life determination part 114 receives the result of calculation outputted from the calculation part 112, determines the life of the image carrier 22 in correspondence with the received result of calculation, and outputs a determination result. For example, the life determination part 114 determines the life of the image carrier 22 based on whether or not the amount of abrasion of the photoreceptor layer 92 (layer thickness decrement amount) outputted from the calculation part 112 has become an abrasion amount as a reference of the life of the image carrier 22 (life reference abrasion amount). Further, the life determination part 114 may determine the life of the image carrier 22 in correspondence with the total layer thickness of the photoreceptor layer 92 outputted from the calculation part 112.

The charging condition controller 116 receives the result of calculation outputted from the calculation part 112, and outputs control information to the power source part 82, to control output of the power source part 82, so as to control the charging condition for the image carrier 22, in correspondence with the received result of calculation. For example, the charging condition controller 116 controls the power source part 82 in correspondence with the total layer thickness of the photoreceptor layer 92 outputted from the calculation part 112. Further, the charging condition controller 116 may control the power source part 82 in correspondence with the amount of abrasion of the photoreceptor layer 92 (layer thickness decrement amount) outputted from the calculation part 112.

Figure 10:
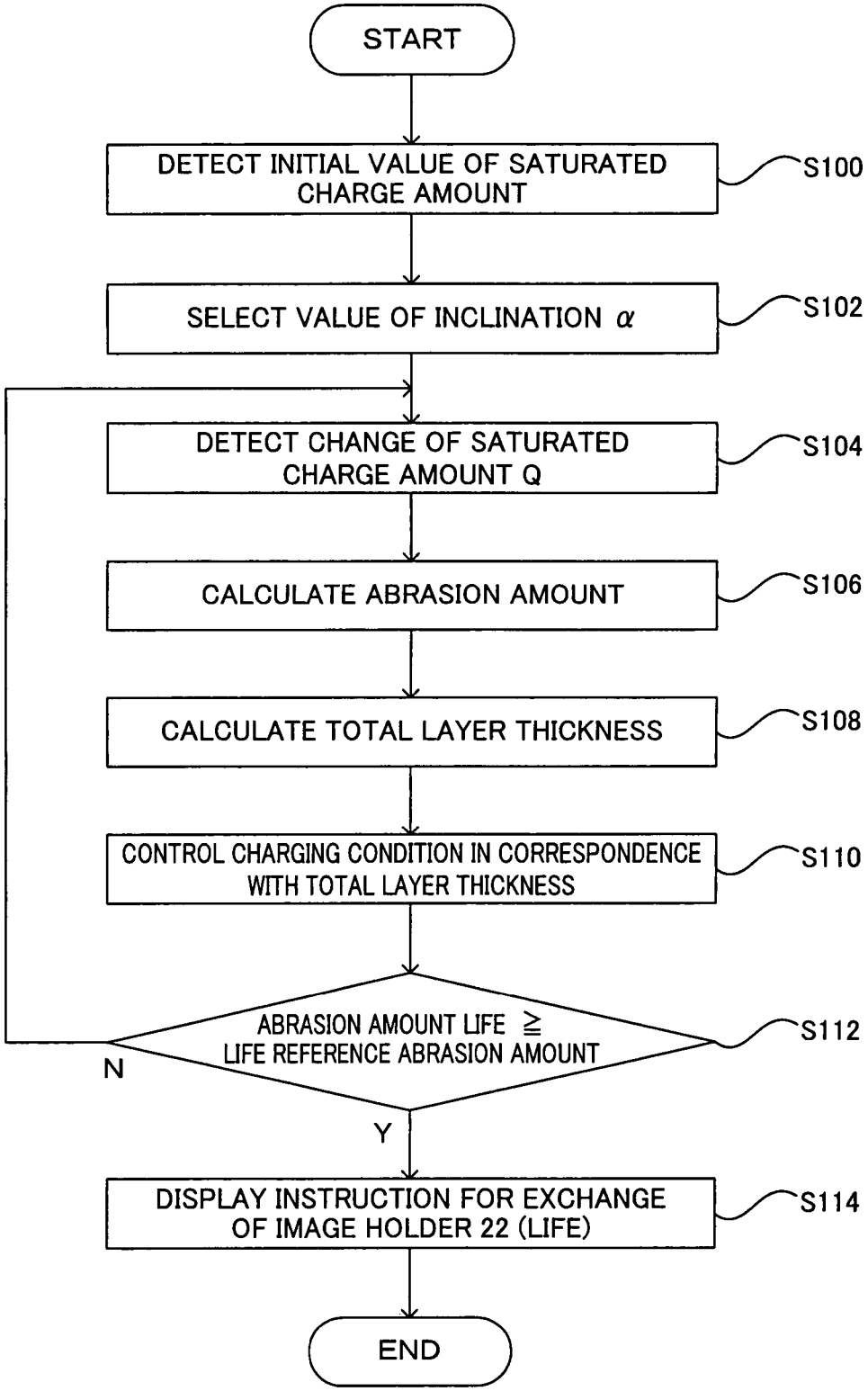
FIG. 10 is a flowchart showing processing for management of the image carrier (S10) performed by execution of the management program by the control unit.

FIG. 10 is a flowchart showing processing for management of the image carrier 22 (S10) performed by execution of the management program 100 by the control unit 62.

As shown in FIG. 10, at step S100, the saturated charge amount detection part 102 detects an initial value of the saturated charge amount of the image carrier 22 via the current detection part 88.

At step S102, the calculation part 112 receives the result of selection of a variation sample from the selection part 106, and receives the value of the inclination a (relation information) corresponding to the selected variation sample from the relation information database 110. That is, the calculation part 112 selects one inclination a value (relation information).

At step S104, to calculate the amount of abrasion using the above expression (2), the calculation part 112 detects the change of the saturated charge amount Q using the detection value Qm of the saturated charge amount and the initial value Q×0 of the saturated charged amount (calculates Qm−Q×0).

At step S106, the calculation part 112 calculates the amount of abrasion of the photoreceptor layer 92 (layer thickness decrement amount) with the above expression (2) using the selected inclination α value (relation information).

At step S108, the calculation part 112 calculates the total layer thickness of the photoreceptor layer 92 using the above-described relation information, the correspondence information and the above expression (3).

At step S110, the charging condition controller 116 controls the power source part 82 in correspondence with the total layer thickness of the photoreceptor layer 92 calculated in the processing at step S108, thereby controls the charging condition for the image carrier 22.

At step S112, the life determination part 114 determines the life of the image carrier 22 based on whether or not the amount of abrasion of the photoreceptor layer 92 (layer thickness decrement amount) outputted from the calculation part 112 has become the abrasion amount as a reference of the life of the image carrier 22 (life reference abrasion amount). When the life determination part 114 determines that the life of the image carrier 22 has been expired (exchange time), the process proceeds to step S114, while when the life determination part 114 determines that the life of the image carrier 22 is not expired, the process returns to step S104.

At step S114, the control unit 62 displays an instruction for exchange of the image carrier 22 via the UI device 64.

Note that in the above exemplary embodiment, the initial value of the saturated charge amount of the photoreceptor layer 92 and the initial value of the total layer thickness, in correspondence with the respective plural variation samples, are stored, and when one of the variation samples has been selected, the amount of abrasion of the photoreceptor layer 92 and the total layer thickness are detected. However, the present invention is not limited to this arrangement. For example, in the management program 100, the initial value of the saturated charge amount of the photoreceptor layer 92 and the initial value of the total layer thickness may be defined with functions.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A total layer thickness detection apparatus for a charged body comprising:

a saturated charge amount detection unit that detects a saturated charge amount of a charged body having a plurality of coating layers with mutually different relative dielectric constants;

a storage unit that stores relation information indicating relation of change of the saturated charge amount of the charged body with respect to a change of layer thickness of a surface layer of the charged body; and a calculation part that calculates a total layer thickness of the plurality of coating layers of the charged body based on the change of the saturated charge amount detected by the saturated charge amount detection unit and the relation information stored in the storage unit.

2. The total layer thickness detection apparatus according to claim 1, wherein when at least layer thickness values or the relative dielectric constants of the respective plurality of coating layers are varied within tolerance, the storage unit further stores a plurality of correspondence information pieces, in which a plurality of relation information pieces, indicating the relation of change of the saturated charge amount of the charged body with respect to the change of layer thickness of the surface layer of the charged body, are respectively brought into correspondence with a plurality of initial values of the saturated charge amount detected by the saturated charge amount detection unit, and the calculation part calculates the total layer thickness of the plurality of coating layers of the charged body based on the initial values of the saturated charge amount detected by the saturated charge amount detection unit and the plurality of correspondence information pieces stored in the storage unit.

3. A charging device comprising:

a charging member that moves into contact with or closer to a charged body, having a plurality of coating layers with mutually different relative dielectric constants, and charges the charged body;

a saturated charge amount detection unit that detects a saturated charge amount of the charged body charged by the charging member;

a storage unit that stores relation information indicating relation of change of the saturated charge amount of the charged body with respect to a change of layer thickness of a surface layer of the charged body; and a calculation part that calculates a total layer thickness of the plurality of coating layers of the charged body based on the change of the saturated charge amount detected by the saturated charge amount detection unit and the relation information stored in the storage unit.

4. The charging device according to claim 3, wherein when at least layer thickness values or the relative dielectric constants of the respective plurality of coating layers are varied within tolerance, the storage unit further stores a plurality of correspondence information pieces, in which a plurality of relation information pieces, indicating the relation of change of the saturated charge amount of the charged body with respect to the change of layer thickness of the surface layer of the charged body, are respectively brought into correspondence with a plurality of initial values of the saturated charge amount detected by the saturated charge amount detection unit, and the calculation part calculates the total layer thickness of the plurality of coating layers of the charged body based on the initial values of the saturated charge amount detected by the saturated charge amount detection unit and the plurality of correspondence information pieces stored in the storage unit.

5. The charging device according to claim 3 further comprising:

a power supply unit that supplies power to the charging member; and a controller that controls the power supply unit based on a result of calculation by the calculation part.

6. The charging device according to claim 4 further comprising:

a power supply unit that supplies power to the charging member; and a controller that controls the power supply unit based on a result of calculation by the calculation part.

7. The charging device according to claims 3, further comprising a determination unit that determines a life of the charged body based on the result of calculation by the calculation part.

8. The charging device according to claims 4, further comprising a determination unit that determines a life of the charged body based on the result of calculation by the calculation part.

9. The charging device according to claims 5, further comprising a determination unit that determines a life of the charged body based on the result of calculation by the calculation part.

10. The charging device according to claims 6, further comprising a determination unit that determines a life of the charged body based on the result of calculation by the calculation part.

11. An image forming apparatus comprising:

an image carrier having a plurality of coating layers with mutually different relative dielectric constants;

a charging member that moves into contact with or closer to the image carrier and charges the image carrier;

a saturated charge amount detection unit that detects a saturated charge amount of the image carrier charged by the charging member;

a storage unit that stores relation information indicating relation of change of the saturated charge amount of the image carrier with respect to a change of layer thickness of a surface layer of the image carrier; and a calculation part that calculates a total layer thickness of the plurality of coating layers of the image carrier based on the change of the saturated charge amount detected by the saturated charge amount detection unit and the relation information stored in the storage unit.

12. The image forming apparatus according to claim 11, wherein when at least layer thickness values or the relative dielectric constants of the respective plurality of coating layers are varied within tolerance, the storage unit further stores a plurality of correspondence information pieces, in which a plurality of relation information pieces, indicating the relation of change of the saturated charge amount of the image carrier with respect to the change of layer thickness of the surface layer of the image carrier, are respectively brought into correspondence with a plurality of initial values of the saturated charge amount detected by the saturated charge amount detection unit, and the calculation part calculates the total layer thickness of the plurality of coating layers of the image carrier based on the initial values of the saturated charge amount detected by the saturated charge amount detection unit and the plurality of correspondence information pieces stored in the storage unit.

13. The image forming apparatus according to claim 11, further comprising:

a power supply unit that supplies power to the charging member; and a controller that controls the power supply unit based on a result of calculation by the calculation part.

14. The image forming apparatus according to claim 12, further comprising:

a power supply unit that supplies power to the charging member; and a controller that controls the power supply unit based on a result of calculation by the calculation part.

15. The image forming apparatus according to claims 11, further comprising a determination unit that determines a life of the charged body based on the result of calculation by the calculation part.

16. The image forming apparatus according to claims 12, further comprising a determination unit that determines a life of the charged body based on the result of calculation by the calculation part.

17. The image forming apparatus according to claims 13, further comprising a determination unit that determines a life of the charged body based on the result of calculation by the calculation part.

18. The image forming apparatus according to claims 14, further comprising a determination unit that determines a life of the charged body based on the result of calculation by the calculation part.

19. A total layer thickness detection method for a charged body comprising:

obtaining a change of a saturated charge amount of a charged body having a plurality of coating layers with mutually different relative dielectric constants; and calculating a total layer thickness of the plurality of coating layers of the charged body based on the obtained change of the saturated charge amount and relation information indicating relation of the change of the saturated charge amount of the charged body with respect to a change of layer thickness of a surface layer of the charged body.

20. A computer readable medium storing a program causing a computer to execute a process for total layer thickness detection for a charged body, the process comprising:

obtaining a change of a saturated charge amount of a charged body having a plurality of coating layers with mutually different relative dielectric constants; and calculating a total layer thickness of the plurality of coating layers of the charged body based on the obtained change of the saturated charge amount and relation information indicating relation of the change of the saturated charge amount of the charged body with respect to a change of layer thickness of a surface layer of the charged body.

* * * * *